US011110734B2

(12) United States Patent
Fuhse et al.

(10) Patent No.: US 11,110,734 B2
(45) Date of Patent: Sep. 7, 2021

(54) SECURITY ELEMENT HAVING A LENTICULAR IMAGE

(71) Applicant: GIESECKE+DEVRIENT CURRENCY TECHNOLOGY GMBH, Munich (DE)

(72) Inventors: Christian Fuhse, Otterfing (DE); Andreas Rauch, Ohlstadt (DE); Georg Depta, Rosenheim (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 16/061,191

(22) PCT Filed: Dec. 12, 2016

(86) PCT No.: PCT/EP2016/002089
§ 371 (c)(1),
(2) Date: Jun. 11, 2018

(87) PCT Pub. No.: WO2017/097430
PCT Pub. Date: Jun. 15, 2017

(65) Prior Publication Data

US 2018/0361777 A1 Dec. 20, 2018

(30) Foreign Application Priority Data

Dec. 10, 2015 (DE) ..... 10 2015 015 991.7

(51) Int. Cl.
*B42D 25/29* (2014.01)
*B42D 25/435* (2014.01)
(Continued)

(52) U.S. Cl.
CPC ..... *B42D 25/29* (2014.10); *B42D 25/351* (2014.10); *B42D 25/373* (2014.10);
(Continued)

(58) Field of Classification Search
CPC .... B42D 25/29; B42D 25/351; B42D 25/373; B42D 25/378; B42D 25/435; B42D 25/355
See application file for complete search history.

(56) References Cited

U.S. PATENT DOCUMENTS 10,105,982 B2 10/2018 Fuhse et al.
2010/0277805 A1 11/2010 Schilling et al.
(Continued)

FOREIGN PATENT DOCUMENTS

AU 2013248632 A1 11/2014
AU 2016238893 A1 10/2016
(Continued)

OTHER PUBLICATIONS

German Search Report from DE Application No. 102015015991.7, dated Oct. 20, 2016.
(Continued)

*Primary Examiner* — David R Dunn
*Assistant Examiner* — Christopher E Veraa
(74) *Attorney, Agent, or Firm* — Workman Nydegger

(57) ABSTRACT

A security element for securing security papers, value documents and other data carriers, having a lenticular image that, from different viewing directions, displays at least two different appearances. The lenticular image includes a lens grid composed of a plurality of microlenses and a radiation-sensitive motif layer arranged spaced apart from the lens grid. The radiation-sensitive motif layer includes, produced by the action of radiation, a plurality of transparency regions that are each arranged in perfect register with the microlenses of the lens grid. Outside the transparency regions produced by the action of radiation, the radiation-sensitive motif layer is opaque and patterned in the form of a first motif such that, when the security element is viewed through
(Continued)

the lens grid from a first viewing direction, the first motif is visible as the first appearance.

21 Claims, 6 Drawing Sheets

(51) Int. Cl.
*B42D 25/351* (2014.01)
*B42D 25/373* (2014.01)
*B42D 25/378* (2014.01)
*B42D 25/355* (2014.01)

(52) U.S. Cl.
CPC ..... *B42D 25/378* (2014.10); *B42D 25/435* (2014.10); *B42D 25/355* (2014.10)

(56) References Cited

U.S. PATENT DOCUMENTS

| | | | | |
|---|---|---|---|---|
| 2011/0019283 | A1* | 1/2011 | Steenblik | D21H 21/40 359/622 |
| 2011/0115212 | A1 | 5/2011 | Hoffmuller et al. | |
| 2011/0127762 | A1 | 6/2011 | Hoffmuller et al. | |
| 2012/0091703 | A1 | 4/2012 | Maguire et al. | |
| 2013/0038942 | A1* | 2/2013 | Holmes | G07D 7/207 359/619 |
| 2013/0154250 | A1 | 6/2013 | Dunn et al. | |
| 2014/0185000 | A1* | 7/2014 | Takahashi | G07D 7/12 349/194 |
| 2015/0367670 | A1* | 12/2015 | Dyball | B32B 7/12 428/29 |
| 2016/0110638 | A1* | 4/2016 | Gregarek | B42D 25/41 235/488 |
| 2017/0028765 | A1* | 2/2017 | Staub | B42D 25/415 |
| 2017/0066279 | A1* | 3/2017 | Karrer Walker | B42D 25/378 |
| 2017/0106689 | A1* | 4/2017 | Fuhse | B42D 25/41 |
| 2017/0165997 | A1* | 6/2017 | Holmes | B42D 25/425 |
| 2017/0326900 | A1* | 11/2017 | Fuhse | B42D 25/324 |
| 2017/0368864 | A1* | 12/2017 | Walter | G02B 5/1842 |
| 2018/0222243 | A1* | 8/2018 | Yamada | B23K 26/00 |
| 2019/0236887 | A1* | 8/2019 | Rich | G02B 3/0056 |

FOREIGN PATENT DOCUMENTS

| | | | |
|---|---|---|---|
| AU | 2017200729 | A1 | 2/2017 |
| CN | 103998955 | A | 8/2014 |
| CN | 104011742 | A | 8/2014 |
| CN | 104023991 | A | 9/2014 |
| CN | 104245346 | A | 12/2014 |
| DE | 102011010127 | A1 | 8/2012 |
| DE | 102012007747 | A1 | 10/2013 |
| DE | 102014004700 | A1 | 10/2015 |
| EP | 0118222 | A1 | 9/1984 |
| EP | 2631085 | A1 | 8/2013 |
| JP | 2003226100 | A | 8/2003 |
| JP | 2010014780 | A | 1/2010 |
| WO | 2005052650 | A2 | 6/2005 |
| WO | 2007087984 | A1 | 8/2007 |
| WO | 2010015381 | A2 | 2/2010 |
| WO | 2010015384 | A2 | 2/2010 |
| WO | 2010083817 | A2 | 7/2010 |
| WO | 2010086113 | A1 | 8/2010 |
| WO | 2010115235 | A1 | 10/2010 |
| WO | 2013056299 | A1 | 4/2013 |
| WO | 2013064268 | A1 | 5/2013 |
| WO | 2013098513 | A1 | 7/2013 |
| WO | 2013156149 | A1 | 10/2013 |
| WO | 2014177267 | A1 | 11/2014 |
| WO | 2015148878 | A2 | 10/2015 |

OTHER PUBLICATIONS

International Search Report from PCT Application No. PCT/EP2016/002089, dated May 4, 2017.

European Office Action from EP Application No. 16823158.7, dated Jul. 26, 2019.

Chinese Search Report from CN Application No. 2016800725075, dated Apr. 8, 2019.

Office Action from corresponding CN Application No. 2016800725075, dated Dec. 12, 2016.

* cited by examiner

SECURITY ELEMENT HAVING A LENTICULAR IMAGE

BACKGROUND

The present invention relates to a security element, for securing security papers, value documents and other data carriers, having a lenticular image that, from different viewing directions, displays at least two different appearances. The present invention also relates to a method for manufacturing such a security element, and a data carrier that is equipped with such a security element.

For protection, data carriers, such as value or identification documents, but also other valuable objects, such as branded articles, are often provided with security elements that permit the authenticity of the data carrier to be verified, and that simultaneously serve as protection against unauthorized reproduction.

Security elements having viewing-angle-dependent effects play a special role in safeguarding authenticity, as these cannot be reproduced even with the most modern copiers. Here, the security elements are furnished with optically variable elements that, from different viewing angles, convey to the viewer a different image impression and, depending on the viewing angle, display for example another color or brightness impression and/or another graphic motif.

In this connection, it is known to provide the data carriers with laser-engraved tilt images for safeguarding. Here, two or more different markings, for example a serial number and an expiration date, are laser-engraved in the data carrier at different angles through an arrangement of cylindrical lenses. The laser radiation here produces a local blackening in the data carrier body, which makes the engraved markings visually visible. When viewed, depending on the viewing angle, only the respective marking engraved from that direction is visible such that, by tilting the data carrier vertically to the axis of the cylindrical lenses, an optically variable tilt effect is created.

In tilt images, to increase counterfeit security, it is further desirable for the depictions that are visible from different directions to have different colors.

Multiple methods for manufacturing tilt images are known, all of which, however, have certain disadvantages. In principle, the known methods can be distinguished according to whether the microimages present in a motif layer are produced with or without the aid of the lens grid of the tilt image.

Without the aid of the lens grid, the microimages can be, for example, printed or embossed. These manufacturing variants are normally very economical, but particularly for the very thin layer structures that are important in security printing, it is normally not possible to arrange the microimages in such perfect register with the lens grid that the various depictions always appear at the same angle, so for example that when multiple banknotes having the same tilt image are viewed next to each other, all banknotes display, from a certain angle, the same depiction.

Other manufacturing methods use the lens grid to pattern the microimages. Here, particularly laser engraving methods are used in which an image is inscribed in a motif layer through the lenses of the lens grid by means of laser. For this, the motif layer is either impinged on with laser radiation through a mask, or a laser beam is scanned over the motif layer to inscribe a desired motif. In both method variants, the motif is inscribed in the focus under the lenses and is thus always in perfect register with the lenses. Furthermore, it is ensured that the inscribed motif is later visible from precisely the direction from which it was exposed in with the laser beam. What is disadvantageous, however, is the fact that it is often very difficult to implement the laser engraving methods on an industrial scale. For example, in foil production, given the foil widths and process speeds common for security applications, the laser engraving of millimeter-sized motifs using a mask or scanner represents a major and costly technological challenge. This is especially true when, to realize two or more different direction-dependently visible motifs from two or more different directions, a different depiction must be laser engraved into the motif layer in each case.

SUMMARY

Proceeding from this, it is the object of the present invention to specify a security element of the kind cited above whose appearances can be produced simply and yet highly precisely.

Said object is solved by the features of the independent claims. Developments of the present invention are the subject of the dependent claims.

According to the present invention, in a generic security element, it is provided that the lenticular image includes a lens grid composed of a plurality of microlenses and a radiation-sensitive motif layer that is arranged spaced apart from the lens grid, the radiation-sensitive motif layer includes, produced by the action of radiation, a plurality of transparency regions that are each arranged in perfect register with the microlenses of the lens grid, and outside the transparency regions produced by the action of radiation, the radiation-sensitive motif layer is opaque and is patterned in the form of a first motif such that, when the security element is viewed from a first viewing direction, the first motif is visible through the lens grid as the first appearance.

When viewed from a second viewing direction, the viewer looks through the transparency regions of the radiation-sensitive motif layer. From said viewing direction, the radiation-sensitive motif layer is not visible and the concrete expression of the second appearance depends on the further design of the security element in the transparency regions, as explained in greater detail below.

The radiation-sensitive motif layer preferably comprises a metal layer. Said metal layer can be combined with at least one further metal layer or with an ink layer, or it can also be part of a thin-film interference layer system and constitute, for example, the reflector layer or absorber layer of such a layer system.

In one advantageous embodiment, the radiation-sensitive motif layer comprises two radiation-sensitive, contrasting metal layers, especially having different colors, at least one of the metal layers being patterned to form the first motif. For example, a metal layer can be silver-colored and consist, for instance, of aluminum or silver, and the other metal layer can consist of a non-ferrous metal or a colored noble metal, for example, of copper or gold. If a less conspicuous motif is to be used, the two metal layers can also differ, for example, only in their brightness or their reflection behavior (glossy/matte) rather than in their color.

In another, likewise advantageous embodiment, the radiation-sensitive motif layer comprises a radiation-sensitive ink layer and a radiation-sensitive metal layer, at least one of the two layers being patterned to form the first motif. The ink layer can be formed, for example, by carbon black or Milori blue, and arbitrary metals may be used for the metal layer, since practically all metals have a sufficiently high contrast to a printed ink layer.

In a further, likewise advantageous embodiment, the radiation-sensitive motif layer comprises a radiation-sensitive metalized embossing pattern that is patterned to form the first motif.

Finally, the radiation-sensitive motif layer can, according to a further, advantageous embodiment, comprise a radiation-sensitive resist layer and, present on the resist layer, a metal layer that is patterned to form the first motif. Here, the transparency regions are especially produced by removing only the exposed or only the unexposed regions of the resist layer.

According to a further, likewise advantageous embodiment, the radiation-sensitive motif layer comprises two radiation-sensitive, contrasting ink layers, especially of different colors, at least one of the ink layers being patterned to form the first motif.

In one preferred embodiment, the radiation-sensitive motif layer is laser sensitive and is ablated or transformed into a transparent modification especially by laser radiation.

The refractive effect of the microlenses of the lens grid defines a focal plane, the radiation-sensitive motif layer advantageously being arranged substantially in said focal plane. Here, the motif layer need not lie exactly in the focal plane, but rather can, in some embodiments, lie up to half a focal length above or below the focal plane. Such a defocused arrangement of the motif layer can be advantageous especially when a particularly small thickness of the security element is to be achieved or a particularly large region below the respective microlenses is to be made transparent. Through an arrangement of the motif layer outside the focal plane, also the viewing angles from which the appearances are visible can be influenced and especially magnified. Here, a large viewing angle range constitutes a particularly desirable product property of the security elements described.

In one advantageous embodiment, it is provided that the lens grid comprises or constitutes a one-dimensional arrangement of microlenses, especially of cylindrical lenses. Likewise advantageously, it can be provided that the lens grid comprises or constitutes a two-dimensional arrangement of microlenses, especially of spherical or aspherical lenses.

Within the scope of this description, lenses whose size in at least one lateral direction lies below the resolution limit of the naked eye are referred to as microlenses. Here, the microlenses can especially be developed to be cylindrical, but also the use of spherical or aspherical lenses may be considered. The latter preferably have a diameter between 5 μm and 300 μm, especially between 10 μm and 50 μm, particularly preferably between 15 μm and 20 μm. Microcylindrical lenses preferably have a width between 5 μm and 300 μm, especially between 10 μm and 50 μm, particularly preferably between 15 μm and 20 μm. The length of the microcylindrical lenses is arbitrary and can for instance when used in security threads or transfer elements, also equal the total width of the thread or transfer element and be several millimeters or several centimeters.

In one advantageous embodiment, there is arranged on the side of the radiation-sensitive motif layer facing away from the lens grid a second motif layer that is patterned in the form of a second motif, such that, when the security element is viewed from a second viewing direction, the second motif is visible through the lens grid and the transparency regions of the radiation-sensitive motif layer as the second appearance. The second motif layer can especially be formed by a printing layer. The second motif layer can be developed to be contiguous, but it can also be only partially present, and outside the second motif layer, the security element can then permit a background that lies below the security element to be perceived.

According to a further, likewise advantageous embodiment, one or more transparent layers are arranged on the side of the radiation-sensitive motif layer facing away from the lens grid, such that, when the security element is viewed from a second viewing direction through the lens grid and the transparency regions of the radiation-sensitive motif layer, a background that lies below the security element is visible as the second appearance.

The present invention also includes a data carrier, especially a value document, a security paper, an identification card, a branded article or the like, having a security element of the kind described.

Such a data carrier can especially include a security element without a second motif layer, in which, in the manner described above, one or more transparent layers are arranged on the side of the radiation-sensitive motif layer facing away from the lens grid. Here, it is further provided that, in a sub-region, the data carrier is provided with a second motif layer that is patterned in the form of a second motif. The security element is then arranged having the lens grid and the transparency regions over the second motif layer, such that, when the security element is viewed from a second viewing direction, the second motif is visible through the lens grid and the transparency regions of the radiation-sensitive motif layer as the second appearance. In this way, it is possible to easily produce data carriers having tilt images that, from a first viewing direction, display a general, generic motif (first motif), and from a second viewing direction, a customized motif (second motif), as explained in greater detail below.

The present invention also includes a method for manufacturing a security element having a lenticular image that, from different viewing directions, displays at least two different appearances, and in the method, a carrier substrate is provided and is furnished with a lens grid composed of a plurality of microlenses and a radiation-sensitive motif layer arranged spaced apart from the lens grid, a plurality of transparency regions arranged in perfect register with the microlenses of the lens grid is produced in the radiation-sensitive motif layer by the action of radiation through the lens grid, and outside the transparency regions produced by the action of radiation, the radiation-sensitive motif layer is developed to be opaque and patterned in the form of a first motif such that, when the security element is viewed from a first viewing direction through the lens grid, the first motif is visible as the first appearance.

In one advantageous procedure, the radiation-sensitive motif layer is impinged on with laser radiation through the lens grid to produce the transparency regions. Here, the radiation-sensitive motif layer is advantageously ablated or transformed into a transparent modification by the laser radiation.

In one alternative, likewise advantageous method variant, the radiation-sensitive motif layer comprises a radiation-sensitive resist layer that is exposed through the lens grid. The transparency regions are then produced by a subsequent step of removing only the exposed or only the unexposed regions of the resist layer.

In one advantageous embodiment of said method variant, it is provided that the regions of the resist layer remaining after the removal of the exposed or the unexposed regions form tacky resist lines that are brought into contact with a patterned metal layer to form the first motif.

A security element according to the present invention can also include more than two depictions that are visible from more than two different viewing directions. In order, for example, to produce three depictions for three different viewing directions, in the above-mentioned (first) radiation-sensitive motif layer are produced by the action of radiation from a second and third different direction in each case a plurality of transparency regions, on the side of the first radiation-sensitive motif layer facing away from the lens grid is arranged a second, opaque and radiation-sensitive motif layer that is patterned in the form of a second motif, in the second radiation-sensitive motif layer are produced by the action of radiation from the third direction in each case a plurality of transparency regions, and finally, on the side of the second radiation-sensitive motif layer facing away from the lens grid is arranged a third motif layer that is patterned in the form of a third motif.

The viewer then sees, from a first viewing direction, the first motif of the first radiation-sensitive motif layer, from a second viewing direction through the transparency regions of the first motif layer, the second motif of the second radiation-sensitive motif layer, and from a third viewing direction through the transparency regions of the first and second motif layer, the third motif of the third motif layer. Similarly to the above description, the third motif layer can also be omitted and, in the transparency regions of the first and second motif layer, the security element can reveal the view of a background layer that lies below the security element.

A higher opacity can also be produced in some regions by laser impingement of the security element. For example, with a suitable doping of the carrier substrate or another layer arranged below the lenses, through thermo- or photochromic effects, a local blackening or color change can be achieved by laser impingement. Here, simultaneously with the blackening or color change, the first motif layer can be removed or made transparent by the residual energy of the laser beam.

Through laser impingement, also additional information can be inscribed in the security element. The, additional information can either be written with such high energy that it is visible from all directions, or with such low energy that a marking is created in each case only in the focus, such that said marking is visible only when viewed from the angle of incidence of the laser radiation. Here, the markings can be so small that they are visible only when looked through in front of a light source.

Further exemplary embodiments and advantages of the present invention are explained below by reference to the drawings, in which a depiction to scale and proportion was dispensed with in order to improve their clarity.

BRIEF DESCRIPTION OF THE DRAWINGS

Shown are.

DETAILED DESCRIPTION OF VARIOUS EMBODIMENTS

Figure 1:
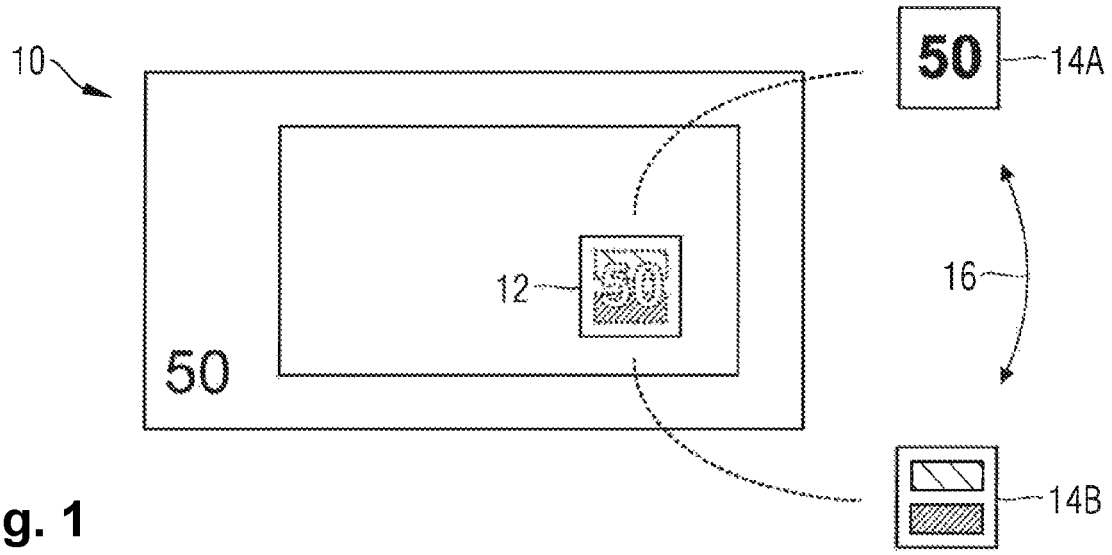
FIG. 1 in schematic depiction, a banknote having an inventive security element that includes a tilt image having two different appearances, FIG. 2 schematically, the layer structure of the security element in FIG. 1, in cross section, FIG. 3 a top view of the security element in FIG. 2 without the lens grid and thus without the focusing effect of the microlenses, FIG. 4(*a*) to FIG. 7(*b*) the manufacture of the security element in FIGS. 2 and 3, (a) showing in each case an intermediate step in the manufacture of the security element and (b) the appearance of the respective intermediate product in top view without the lens grid and thus without the focusing effect of the microlenses, FIG. 8 schematically, a security element according to the present invention, in which the second motif layer was omitted, FIGS. 9(*a*) to 9(*d*),intermediate steps in the manufacture of an inventive security element that uses an embossing pattern to produce a contrast, and FIGS. 10(*a*) to 10(*c*), intermediate steps in the manufacture of a security element according to the present invention without the use of a laser.

The invention will now be explained using the example of security elements for banknotes. For this, FIG. 1 shows a schematic diagram of a banknote 10 that is provided with an inventive security element 12 in the form of an adhered transfer element. In the exemplary embodiment, the security element 12 constitutes a tilt image that, depending on the viewing direction, displays one of two different appearances 14A, 14B.

However, the present invention is not limited to the transfer elements in banknotes, shown for illustration, but can, for example, also be used in security threads, wide security strips or cover foils that are arranged over an opaque region, a window region or a through opening in a data carrier.

Returning to the depiction in FIG. 1, the two appearances in the exemplary embodiment are formed by a dichromatic depiction 14A of the value numeral "50" and a depiction 14B of two colored rectangles, but it is understood that, in practice, the appearances typically constitute more complex motifs, such as geometric patterns, portraits, codes, numberings, or architectural, technological or natural motifs. Upon tilting 16 the banknote 10 or a corresponding change in the viewing direction, the appearance of the security element 12 alternates back and forth between the two appearances 14A, 14B.

While lenticular images having tilt images are known per se, the present invention provides a specially designed lenticular image in which the depicted motifs are introduced into the motif layer of the lenticular image in a particularly simple yet highly precise manner. In particular, neither a mask for exposing by means of laser nor a fine scanning of the motif layer with a sharply focused laser beam or multiple laser impingement from different directions is required.

Figure 2:
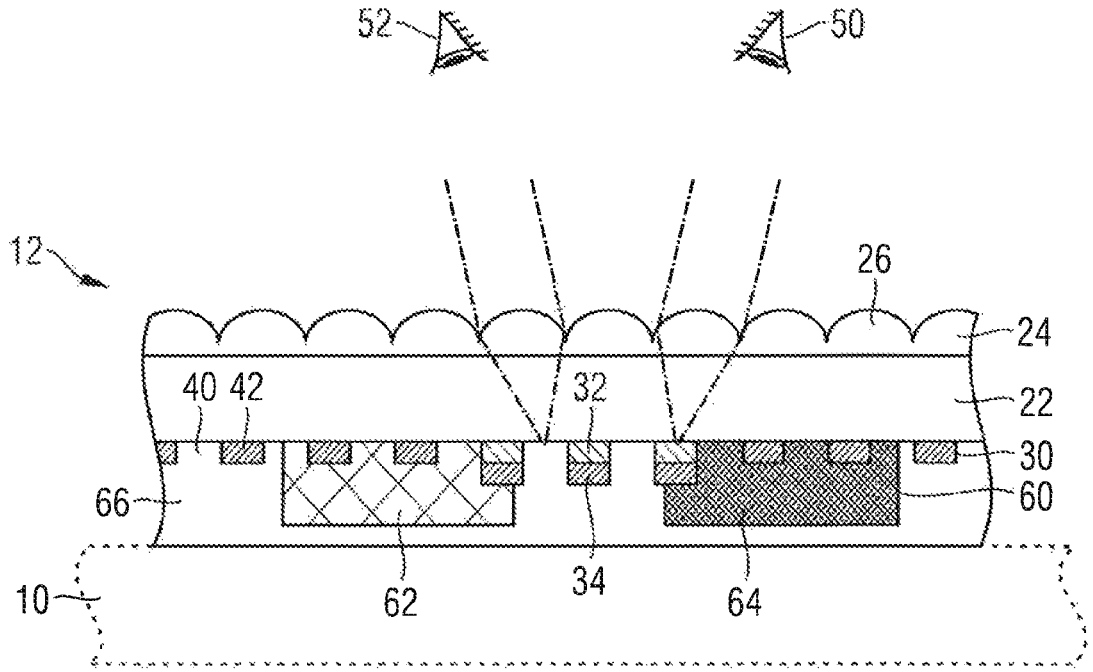
Figure 3:
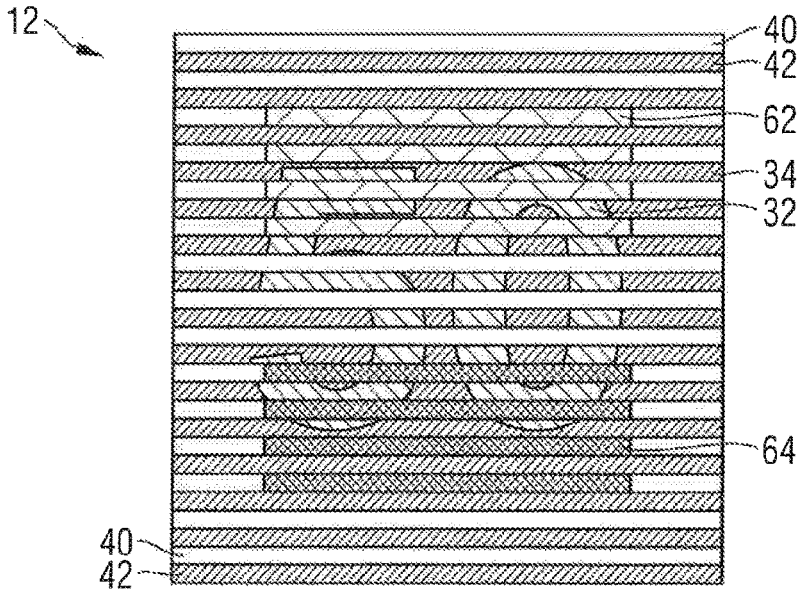

FIG. 2 shows, schematically, the layer structure of the security element 12 according to the present invention, in cross section, with only the portions of the layer structure that are required to explain the functional principle being depicted. FIG. 3 shows a top view of the security element 12 without the lens grid and thus without the focusing effect of the microlenses.

FIGS. 2 and 3 show the finished security element 12, but to understand the complex layer structure and the coaction of the individual layers, especially also the detailed description of the manufacture of the security element with reference to FIGS. 4 to 7 is helpful.

The security element 12 includes a carrier substrate 22 in the form of a transparent plastic foil, for example an approximately 20 μm thick polyethylene terephthalate (PET) foil. The carrier substrate 22 comprises opposing first and second main surfaces, the first main surface being provided with a lens grid 24 composed of a plurality of substantially cylindrical microlenses 26.

Here, the thickness of the carrier substrate 22 and the curvature of the focusing lens surfaces of the microlenses 26 are coordinated with each other in such a way that the focal length of the microlenses 26 substantially corresponds to the thickness of the carrier substrate 22. The focal plane of the microlenses 26 then substantially coincides with the second, opposing main surface of the carrier substrate 22. As explained above, however, it can, in some embodiments, also be expedient to not have the focal plane coincide with the second main surface of the carrier substrate, for example to produce particularly thin security elements.

On the second main surface of the carrier substrate 22 is arranged a laser-sensitive motif layer 30 that, in the exemplary embodiment shown, consists of two laser-sensitive metal layers of different colors, for example an aluminum layer 32 that is applied in some regions and a copper layer 34 that covers the aluminum layer 32 contiguously.

The motif layer 30 includes a plurality of parallel, linear transparency regions in the form of linear gaps 40 that were produced in perfect register with the microlenses 26 of the lens grid 24 in the manner explained in greater detail below. The regions of the motif layer 30 between the gaps 40 form material regions left in place 42 that are likewise developed to be linear and in perfect register with the microlenses 26. In the exemplary embodiment, the linear gaps 40 and the linear material regions 42 have the same width, but in general, the gaps and the material regions can also have different widths.

In the material regions left in place 42, the motif layer 30 is opaque and patterned in the form of a first motif, in the exemplary embodiment in the form of the value numeral "50". Specifically, the aluminum layer 32 here constitutes the number "50" having a silvery appearance, while the copper layer 34 forms a well-contrasting, copper-colored background for the value numeral "50". Due to the focusing effect of the microlenses 26, from a first viewing direction 50, a viewer looks, in each case, at the material regions left in place 42 of the motif layer 30 and thus perceives, as the appearance 14A, the silver-colored value numeral "50" in front of the copper-colored background. The gaps 40 are not visible from the viewing direction 50, such that the depiction of the value numeral "50" appears for the viewer to be contiguous.

From a second viewing direction 52, in contrast, due to the focusing effect of the microlenses 26, the viewer looks in each case at the gaps 40 in the motif layer 30, such that the motif layer 30 is not visible from said viewing direction and the perceived appearance depends on the further design of the security element in the gaps 40. In the exemplary embodiment shown, a second motif layer in the form of a printing layer 60 that is patterned in the form of a second motif is present on the side of the motif layer 30 facing away from the lens grid 24. As the second motif, for illustration, a simple motif composed of two different-colored rectangles 62, 64 is shown, but it is understood that, here, arbitrarily complex motifs can be produced as desired.

When viewed from the second viewing direction 52, the viewer thus looks through the gaps in the first motif layer 30 at, in each case, the second motif layer 60 and thus perceives the two colored rectangles 62, 64 as the appearance 14B.

The security element 12 typically includes further layers 66, such as protective, cover or additional functional layers, which, however, are presently not significant and are thus not described in greater detail. One or more of the further layers 66 can be opaque and form a background for the depiction of the second motif layer 60, or the further layers can be transparent or translucent and, in the case of a non-contiguous second motif layer, reveal in some regions a view through the security element 12.

The second motif layer 60 can be contiguous or, as in the exemplary embodiment in FIGS. 2 and 3, itself be only partially present and thus reveal, in the regions that lie outside the motif layer 60, the view of a background layer that lies below the security element 12. The background layer can be formed, for example, by the substrate of the banknote 10 (indicated by a dotted line in FIG. 2) or another data carrier on which the security element 12 is applied. The background layer can be monochromatic or itself patterned and include, for example, a piece of information that is perceptible in the gaps 40 from the viewing direction 52. The security element 12 can also be present in a window region of a data carrier, such that the transparent regions that lie outside the motif layer 60 constitute see-through regions in the security element 12.

The manufacture of the security element 12 will now be explained with reference to FIGS. 4 to 7, with subfigure (a) of the drawings showing in each case an intermediate step in the manufacture of the security element, and subfigure (b), the appearance of the respective intermediate product in top view without the lens grid 24 and thus without the focusing effect of the microlenses 26.

Figure 4A:
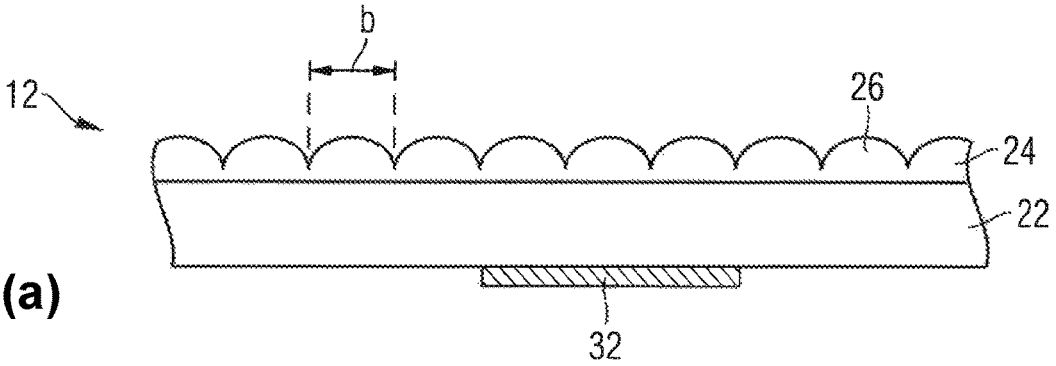
Figure 4B:
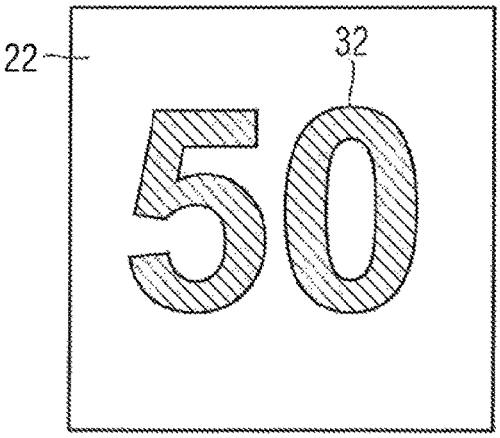

With reference first to FIG. 4, a carrier substrate 22 in the form of an approximately 20 μm thick polyethylene terephthalate (PET) foil is provided and, on a first main surface, furnished, preferably by embossing, with a lens grid 24 composed of a plurality of substantially cylindrical microlenses 26 of a width b=15 μm. Then an aluminum layer 32 in the form of value numeral "50" in the desired original size is applied on the opposing second main surface of the carrier substrate 22. Here, the patterning of the aluminum layer 32 can be achieved, for example, by imprinting a washable ink outside the region of the value numeral, metalizing the printed and unprinted region contiguously, and subsequently washing off the washable ink and the metalization lying over it. Alternatively, also, for example, an etching mask can be printed and the demetalization carried out in an etching process. As shown in the top view in FIG. 4(*b*), after this method step, the aluminum layer 32 patterned in the form of value numeral "50" is present on the carrier substrate 22.

Figure 5A:
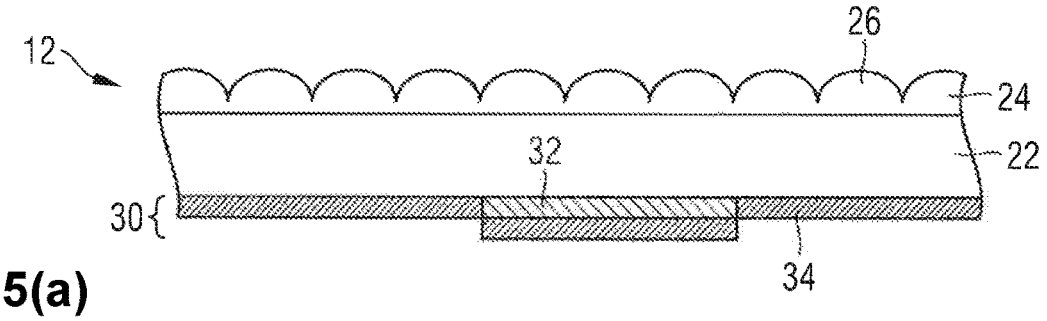
Figure 5B:
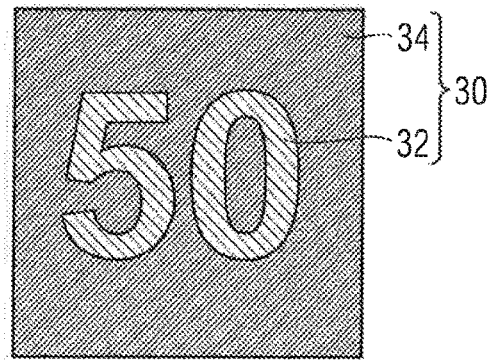

Subsequently, as a second metal layer, a copper layer 34 is vapor deposited onto the patterned aluminum layer 32 contiguously, as depicted in FIG. 5(*a*). What is essential here is that the visual appearance of the second metal layer 34 differs sufficiently from that of the first metal layer 32 to produce a good contrast when viewed. Thus, in place of the copper layer 34, also a gold layer, for example, or a color-contrasting alloy can be applied. Also a multilayer system, for example a thin-film interference layer system, having a reflector, a dielectric spacing layer and an absorber, that displays different colors direction-dependently may be considered. As shown in the top view in FIG. 5(*b*), after this method step, the motif layer 30 having the silver-colored value numeral "50" (reference sign 32) is present in front of the copper-colored background 34.

Figure 6A:
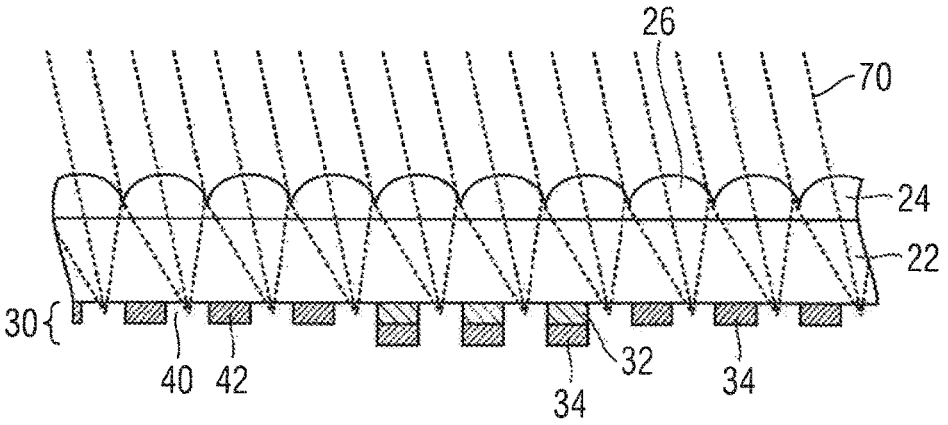
Figure 6B:
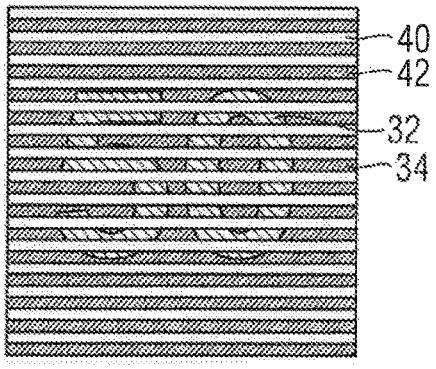

In the next method step, the surface of the motif layer 30 is impinged on in large areas with laser radiation 70 through the lens grid 24 from a predetermined direction, as shown in FIG. 6(*a*). Due to the cylindrical microlenses 26, the laser radiation 70 is focused linearly on the motif layer 30 arranged on the second main surface of the carrier substrate 22 and, there, ablates the copper layer 34 or, in the region of the value numeral "50", both metal layers 32, 34, such that linear gaps 40 are created in the motif layer 30. It is also possible to, not ablate the metal layers, but merely transform them into a transparent modification through the action of the laser radiation. As in the top view shown in FIG. 6(*b*), after this method step, the motif layer 30 having the silver-colored value numeral "50" (reference sign 32) and the copper-colored background 34 is then present only in the material regions left in place 42. Between the material regions 42, due to the laser impingement, transparency regions 40 were created in which the intermediate product is transparent.

Figure 7A:
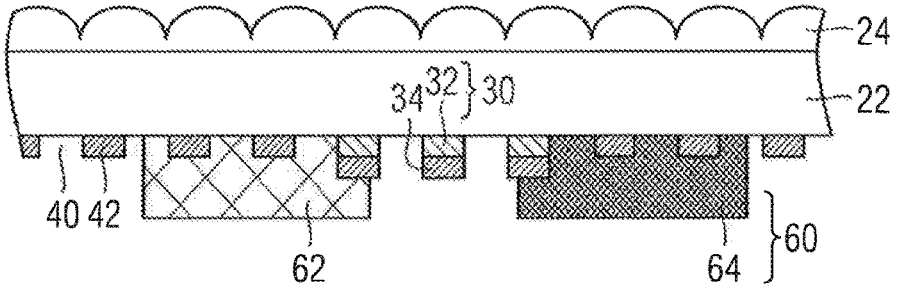
Figure 7B:
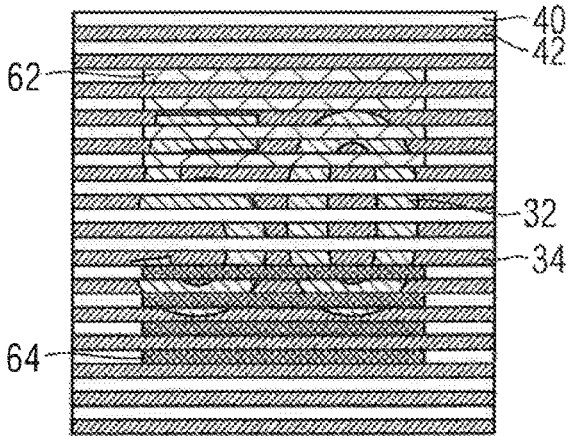

In one variant of the present invention, after this method step, the security element 12 can already be brought to final processing and there, for example, be provided with a transparent protective layer on the second main surface, as described in greater detail below in connection with FIG. 8. In the inventive variant of the present exemplary embodiment (FIG. 7(*a*)), in contrast, also a second motif layer 60 that is patterned in the form of a second motif having two colored rectangles 62, 64 is imprinted on the first motif layer 30 provided with gaps 40. After this method step, the security element now comprises, as shown in FIG. 7(*b*), two patterned motif layers 30 and 60, whose motifs are each visible from the viewing directions 50, 52 (FIG. 2). To the extent visible when viewed, both motifs are also arranged in perfect register with the microlenses 26 of the lens grid 24 although only a single laser impingement step was required for their production.

Figure 8:
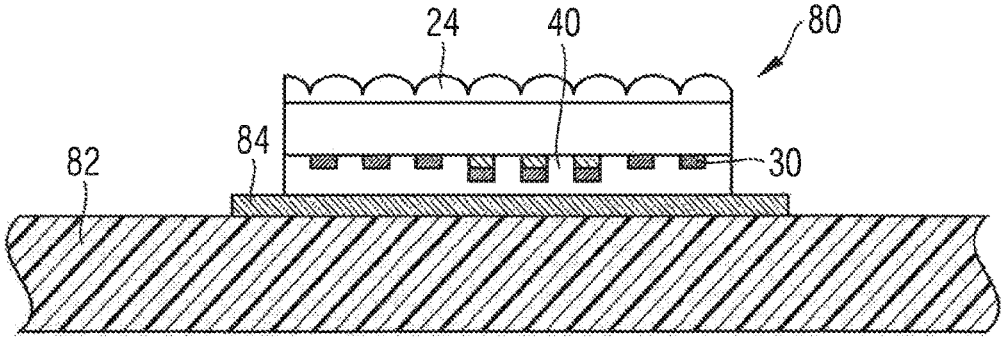
Figure 9A:
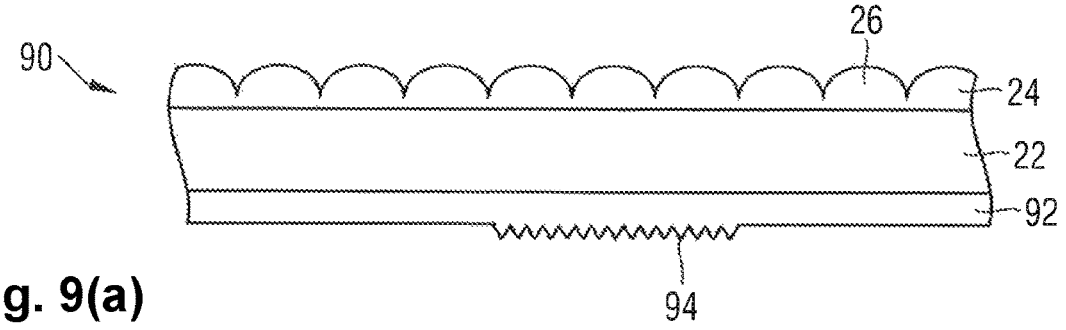
Figure 9B:
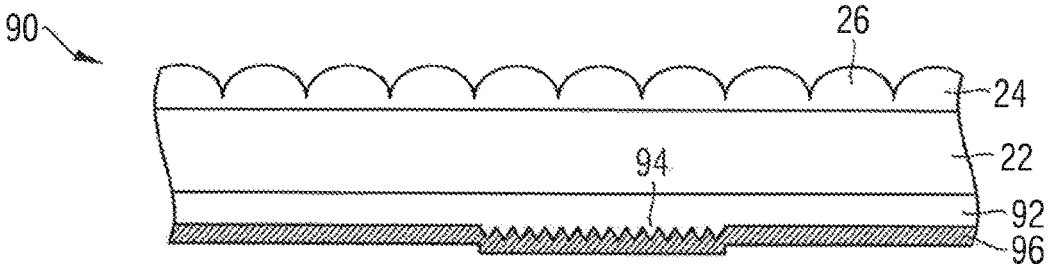
Figure 9C:
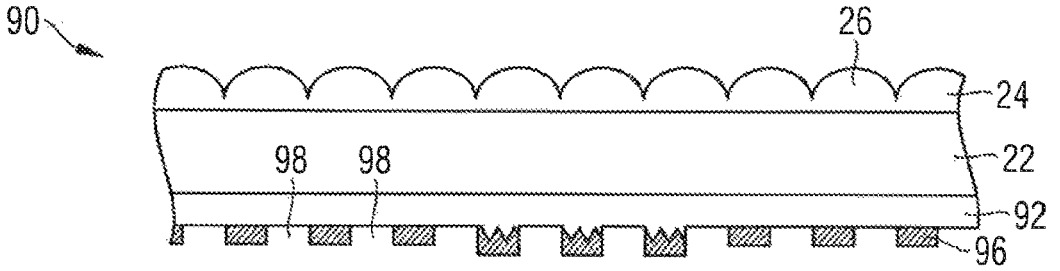
Figure 9D:
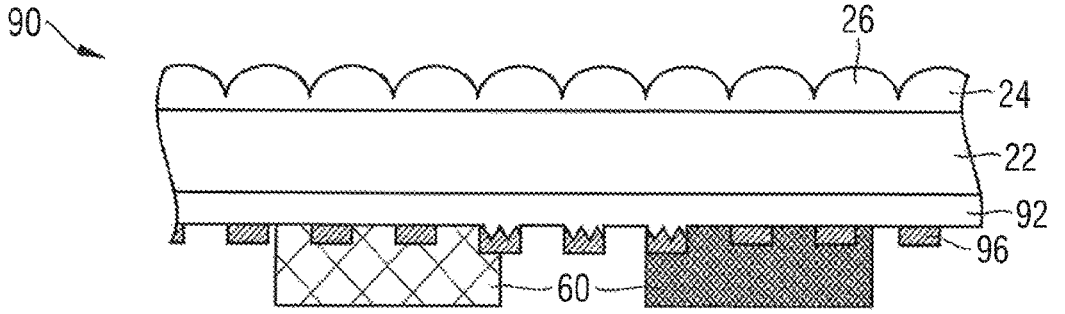

In the variant shown in FIG. 8, the second motif layer 60 was omitted and, at most, transparent layers, for example a transparent protective or cover layer and/or a transparent adhesive layer, were applied to the first motif layer 30. The security element 80 thus created displays, when viewed from a first viewing direction, the first motif already described above, formed by the first motif layer 30, and reveals, from a second viewing direction, the view of a background layer in the gaps 40 of the first motif layer 30.

In this way, data carriers having tilt images that display, from a first viewing direction, a general, generic motif, and from a second viewing direction, an individualized motif, can be produced particularly easily. For example, the security element 80 can be designated for use in identification documents 82 and, with its motif layer 30, display a national emblem as the first, generic motif. Since the security element 80 itself displays only the generic "national emblem" motif, it can be used unaltered for all similar identification documents 82.

A motif present in a data region 84 of the identification document 82 serves as the customized motif, for example a passport photo of the holder. Said customized motif is different for each identification document 82. The security element 80 will now be adhered to the data region 84 with the uncovered motif layer 30, 40 such that, from the first viewing direction, the national emblem of the motif layer 30 is visible, and from the second viewing direction, the customized motif of the data region 84.

In the exemplary embodiments described so far, the first motif layer is formed by two laser-sensitive metal layers. Equally, it is possible to form the first motif layer through two laser-sensitive ink layers or from a laser-sensitive ink layer and a laser-sensitive metal layer, with, for example, carbon black or Milori blue being able to be used for the or one of the ink layer(s), and an arbitrary metalization, for example aluminum, for the metal layer.

A further embodiment according to the present invention uses an embossing pattern to produce a contrast, as described below with reference to FIG. 9, which shows, in (a) to (d), four intermediate steps in the manufacture of a corresponding security element 90.

With reference to FIG. 9(*a*), first, a carrier substrate 22 is provided and is furnished on a first main surface with a lens grid 24 that consists of a plurality of substantially cylindrical microlenses 26 of a width of 20 μm. A transparent embossing lacquer layer 92 is applied on the opposing second main surface of the carrier substrate 22 and furnished in a motif-shaped sub-region 94 with an embossing pattern. Here, different embossing patterns, for example hologram gratings or other diffraction patterns, but also subwavelength patterns such as moth-eye patterns or chromophoric subwavelength gratings can be used.

The embossing lacquer layer 92 having the embossing pattern 94 is then metalized contiguously with a laser-sensitive metal layer, for example an aluminum layer 96, as depicted in FIG. 9(*b*). In this exemplary embodiment, the radiation-sensitive motif layer is formed by the metalized and embossed embossing lacquer layer 92, 94, 96.

Subsequently, the surface of the embossing lacquer layer 92 is impinged on in large areas with laser radiation through the lens grid 24 from a predetermined direction and, in this way, the aluminum layer 96 is ablated in some regions or transformed into a transparent modification such that linear transparency regions 98 are produced in the metalized embossing lacquer layer, as depicted in FIG. 9(*c*).

The security element thus created can either be brought to final processing in this form or, as shown in FIG. 9(*d*), a second motif layer 60 that is patterned in the form of a second motif can again be imprinted. The first motif formed by the embossing 94 is then visible from a first viewing direction, while the second motif of the motif layer 60 is visible in the transparency regions 98 of the embossing lacquer layer from a second viewing direction.

While the exemplary embodiments described above use a laser impingement of the first motif layer to produce the transparency regions, according to the present invention, security elements can also be manufactured without the use of a laser. For illustration, FIG. 10 shows, in (a) to (c), three intermediate steps in the manufacture of a corresponding security element 100.

Figure 10A:
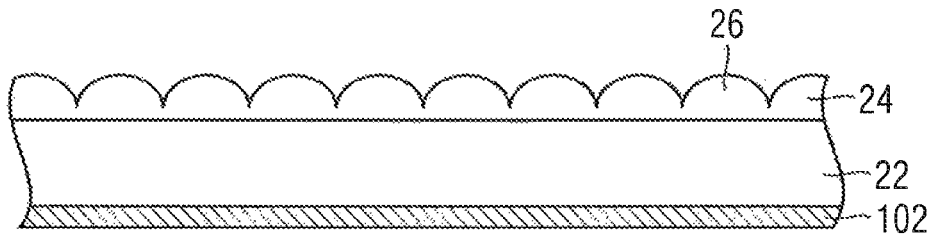
Figure 10B:
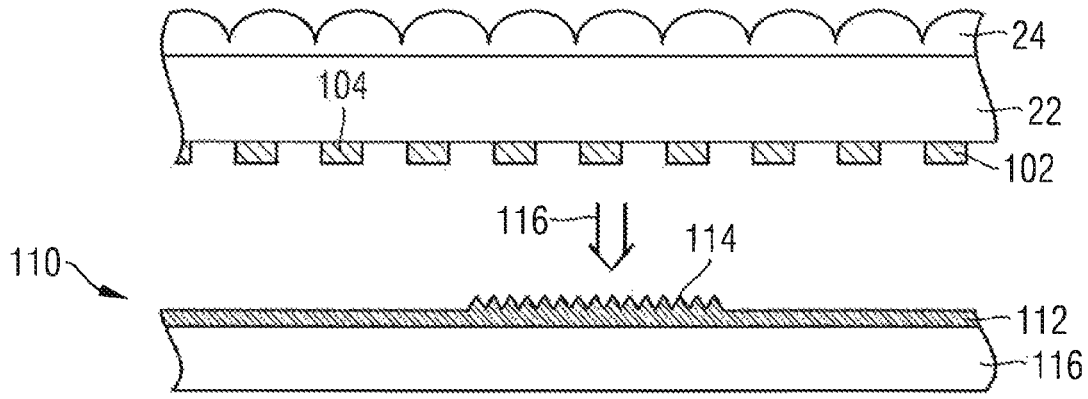
Figure 10C:
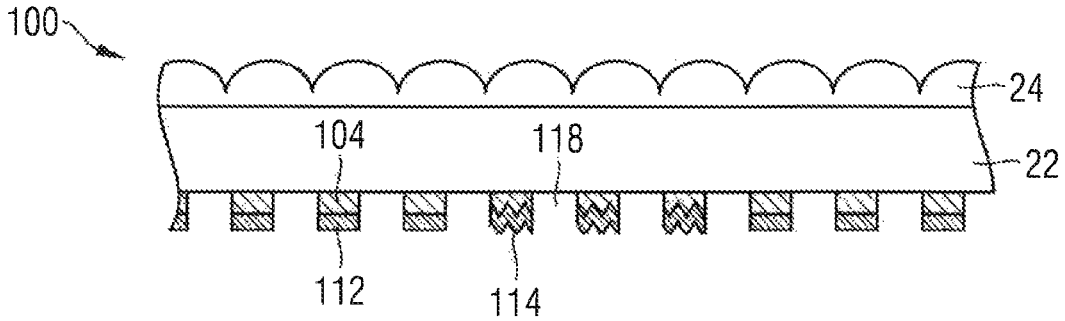

With reference to FIG. 10(*a*), first, a carrier substrate 22 is provided and is furnished on a first main surface with a lens grid 24 that consists of a plurality of substantially cylindrical microlenses 26 of a width of 30 μm. On the opposing second main surface of the carrier substrate 22, a radiation-sensitive, tacky resist lacquer 102 is applied contiguously and, with a suitable light source, exposed contiguously through the lens grid 24 from a predetermined direction (not shown).

Due to the focusing of the exposing radiation through the cylindrical microlenses 26, the exposed and unexposed sub-regions each constitute linear sub-regions of the resist lacquer 102 that are in register with the microlenses 26. In the development of the resist, either the exposed or the unexposed regions are removed, depending on the resist type used. After the development, the remaining resist regions are then formed, independently of the resist type, by still-tacky resist lines 104 that are arranged in perfect register with the microlenses 26, as shown in the upper image half in FIG. 10(*b*).

In a separate manufacturing step, a donor foil 110 having a desired first motif is produced in that a metal layer 112 having a motif-shaped embossing pattern 114 is provided on a carrier foil 116 having weak metal adhesion. The donor foil 110 is depicted in the lower image half in FIG. 10(*b*).

The resist-coated carrier foil 22 and the metalized donor foil 110 are then brought into contact with each other (reference sign 116). Here, at the locations at which resist lines 104 are present on the carrier foil 22, the metal 112 having the motif-shaped embossing pattern 114 adheres to said resist lines, and in this way is transferred in some regions from the donor foil 110 to the carrier foil 22. In the regions lying between the resist lines 104, no metal is transferred, such that said regions form linear transparency regions 118 in the security element 100, as depicted in FIG. 10(*c*).

Overall, in this way, a design similar to that in FIG. 9(*c*) is created in which the desired first motif is visible, when viewed from a first viewing direction, as an embossing pattern 112, 114 designed in the shape of a motif, while from a second viewing direction, the viewer looks at the transparency regions 118 between the metal-covered resist lines 104. The security element thus created can either be brought to a final processing in this form or can, in the manner described above, be provided with a second motif layer having a second motif that is visible in the transparency regions 118 from the second viewing direction.

In a variant not shown here, a donor foil having a desired motif is produced in that two metal layers having a motif-shaped pattern, for example a contiguously applied copper layer and an aluminum layer that covers the copper layer in some regions, are provided on a carrier foil having weak metal adhesion. What is essential here is that the metal layers are prepared on the carrier foil in the reverse order of how they later come to lie on the resist-coated carrier foil 22. Moreover, the visual appearance of the first metal layer should differ sufficiently from that of the second metal layer to produce a good contrast when viewed.

The resist-coated carrier foil 22 and the metalized donor foil are then brought into contact with each other. Here, the metal layers having the motif-shaped pattern, as described above in connection with FIG. 10, are transferred in some regions from the donor foil to the carrier foil 22. No metal is transferred in the regions that lie between the resist lines 104, such that said regions form linear transparency regions.

Overall, a design is thus created similar to that in FIG. 6, in which the desired first motif is visible as a pattern designed in the shape of a motif when viewed from a first viewing direction, while from a second viewing direction, the viewer looks at the transparency regions between the metal-covered resist lines 104.

LIST OF REFERENCE SIGNS

10 Banknote
12 Security element
14A, 14B Appearances
16 Tilt direction
22 Carrier substrate
24 Lens grid
26 Microlenses
30 Laser-sensitive motif layer
32 Aluminum layer
34 Copper layer
40 Gaps
42 Material regions left in place
50, 52 Viewing directions
60 Second motif layer
62, 64 Colored rectangles
66 Further layers
70 Laser radiation
80 Security element
82 Identification document
84 Data region
90 Security element
92 Embossing lacquer layer
94 Motif-shaped sub-region having an embossing pattern
98 Transparency regions
100 Security element
102 Resist lacquer
110 Donor foil
112 Metal layer
114 Motif-shaped embossing pattern
116 Carrier foil
118 Transparency regions

The invention claimed is:

1. A security element for securing security papers, value documents and other data carriers, having a lenticular image that, from different viewing directions, displays at least a first appearance and a second appearance, the lenticular image including a lens grid composed of a plurality of microlenses and a radiation-sensitive motif layer that is arranged spaced apart from the lens grid, the radiation-sensitive motif layer including, produced by the action of radiation, a plurality of transparency regions that are each arranged in perfect register with the microlenses of the lens grid, such that, when the security element is viewed from a second viewing direction through the lens grid and the transparency regions of the radiation-sensitive motif layer, the second appearance is visible, and outside the transparency regions produced by the action of radiation, the radiation-sensitive motif layer being opaque and being patterned in the form of a first motif such that, when the security element is viewed through the lens grid from a first viewing direction, the first motif is visible as the first appearance, wherein there is arranged on the side of the radiation-sensitive motif layer facing away from the lens grid a second motif layer that is patterned in the form of a second motif, such that, when the security element is viewed from the second viewing direction, the second motif is visible through the lens grid and the transparency regions of the radiation-sensitive motif layer as the second appearance.

2. The security element according to claim 1, wherein the radiation-sensitive motif layer comprises a metal layer, and wherein the transparency regions form gaps in the first motif that, when the security element is viewed through the lens grid from a first viewing direction, are not visible as part of the first appearance.

3. The security element according to claim 1, wherein the radiation-sensitive motif layer comprises two radiation-sensitive, contrasting metal layers, at least one of the metal layers being patterned to form the first motif.

4. The security element according to claim 1, wherein the radiation-sensitive motif layer comprises a radiation-sensitive ink layer and a radiation-sensitive metal layer, at least one of the two layers being patterned to form the first motif.

5. The security element according to claim 1, wherein the radiation-sensitive motif layer comprises a radiation-sensitive metalized embossing pattern that is patterned to form the first motif.

6. The security element according to claim 1, wherein the radiation-sensitive motif layer comprises a radiation-sensitive resist layer and, present on the resist layer, a metal layer that is patterned to form the first motif.

7. The security element according to claim 1, wherein the radiation-sensitive motif layer comprises two radiation-sensitive, contrasting ink layers, at least one of the ink layers being patterned to form the first motif.

8. The security element according to claim 1, wherein the radiation-sensitive motif layer is laser sensitive.

9. The security element according to claim 1, wherein the refractive effect of the microlenses defines a focal plane and the radiation-sensitive motif layer is arranged substantially in said focal plane.

10. The security element according to claim 1, wherein the lens grid comprises or constitutes a one-dimensional arrangement of microlenses.

11. The security element according to claim 1, wherein the lens grid comprises or constitutes a two-dimensional arrangement of microlenses.

12. The security element according to claim 1, wherein the second motif layer is formed by a printing layer.

13. The security element according to claim 1, wherein the second motif layer is present only discontiguously and, outside the second motif layer, the security element permits a background that lies below the security element to be perceived.

14. The security element according to claims 1, wherein there are arranged on the side of the radiation-sensitive motif layer facing away from the lens grid one or more transparent layers such that, when the security element is viewed from the second viewing direction through the lens grid and the transparency regions of the radiation-sensitive motif layer, a background that lies below the security element is visible as the second appearance.

15. A data carrier having a security element according to claim 1.

16. A method for manufacturing a security element having a lenticular image that, from different viewing directions, displays at least a first appearance and a second appearance, the method comprising:

providing a carrier substrate furnished with a lens grid composed of a plurality of microlenses and a radiation-sensitive motif layer arranged spaced apart from the lens grid, said radiation-sensitive motif layer being opaque and patterned in the form of a first motif; and producing a plurality of transparency regions in the radiation-sensitive motif layer by action of radiation through the lens grid, said transparency regions arranged in perfect register with the microlenses of the lens grid;

wherein, when the security element is viewed from a second viewing direction through the lens grid and the transparency regions of the radiation-sensitive motif layer, the second appearance is visible;

wherein, when the security element is viewed through the lens grid from a first viewing direction, the first motif of the radiation-sensitive motif layer outside the transparency regions produced by the action of radiation is visible as the first appearance; and wherein there is arranged on the side of the radiation-sensitive motif layer facing away from the lens grid a second motif layer that is patterned in the form of a second motif, such that, when the security element is viewed from the second viewing direction, the second motif is visible through the lens grid and the transparency regions of the radiation-sensitive motif layer as the second appearance.

17. The method according to claim 16, wherein the radiation-sensitive motif layer is impinged on with laser radiation through the lens grid to produce the transparency regions.

18. The method according to claim 17, wherein the radiation-sensitive motif layer is ablated by the laser radiation or transformed into a transparent modification.

19. The method according to claim 16, wherein the radiation-sensitive motif layer comprises a radiation-sensitive resist layer that is exposed through the lens grid, and the transparency regions are produced by a subsequent step of removing only the exposed or only the unexposed regions of the resist layer.

20. The method according to claim 16, wherein the method comprises only a single laser impingement step from a predetermined direction for manufacturing the security element, such that both the first motif and the second motif are arranged in perfect register with the microlenses of the lens grid.

21. A security element for securing security papers, value documents and other data carriers, having a lenticular image that, from different viewing directions, displays at least a first appearance and a second appearance, the lenticular image including a lens grid composed of a plurality of microlenses and a radiation-sensitive motif layer that is arranged spaced apart from the lens grid, the radiation-sensitive motif layer including, produced by the action of radiation, a plurality of transparency regions that are each arranged in perfect register with the microlenses of the lens grid, such that, when the security element is viewed from a second viewing direction through the lens grid and the transparency regions of the radiation-sensitive motif layer, the second appearance is visible, and outside the transparency regions produced by the action of radiation, the radiation-sensitive motif layer being opaque and being patterned in the form of a first motif such that, when the security element is viewed through the lens grid from a first viewing direction, the first motif is visible as the first appearance, wherein there are arranged on the side of the radiation-sensitive motif layer facing away from the lens grid one or more transparent layers such that, when the security element is viewed from the second viewing direction through the lens grid and the transparency regions of the radiation-sensitive motif layer, a background that lies below the security element is visible as the second appearance.

* * * * *